United States Patent [19]

Costa

[11] 3,951,318

[45] Apr. 20, 1976

[54] DISPENSING DEVICE COMPOSED OF A CAN AND A NOZZLE FIXEDLY ATTACHABLE THERETO

[76] Inventor: Allan A. Costa, 682 Udall St., West Islip, N.Y. 11795

[22] Filed: Dec. 11, 1974

[21] Appl. No.: 531,538

[52] U.S. Cl. ..... 222/569
[51] Int. Cl.[2] ..... B65D 25/48
[58] Field of Search ..... 222/566, 567, 569

[56] References Cited

UNITED STATES PATENTS

| | | | |
|---|---|---|---|
| 2,727,659 | 12/1955 | Nyden | 222/566 X |
| 2,813,664 | 11/1957 | Punte | 222/566 |
| 3,388,842 | 6/1968 | Costa | 272/566 |

*Primary Examiner*—Robert B. Reeves
*Assistant Examiner*—David A. Scherbel
*Attorney, Agent, or Firm*—Hane, Baxley & Spiecens

[57] ABSTRACT

There is disclosed a dispensing device composed of a can and a nozzle fixedly attachable thereto. The can of the device is generally a container made of sheet metal and having a top wall including an opening and a nozzle made of a synthetic plastics material having a limited inherent flexibility. The nozzle has a wide opening communicating with the equally wide can opening for rapid and convenient filling of the can with material such as a liquid or powder and for equally rapidly discharging the material in the can through the nozzle. The can and the nozzle are separately manufactured by independent and different manufacturing operations and securement of the nozzle to the can is effected by forcing the nozzle with its lower portion into and through the can opening in a manner so that the nozzle is axially retained within the can by means of a circumferential protrusion on the nozzle which is pushed past the top wall rim defining the can opening by utilizing the flexibility of the material of which the nozzle is made. The nozzle is also secured in an angular fixed position relative to the can by serrations on the can which are so disposed that they will bite into the material of the nozzle when and while the nozzle is forced into the can. Such biting of the serrations into the nozzle material occurs automatically in any angular position of the nozzle relative to the can. Locking of the nozzle against rotation relative to the can is required to permit convenient screwing on and off of a closure cap to the nozzle when the device is not in use.

6 Claims, 7 Drawing Figures

FIG. 2
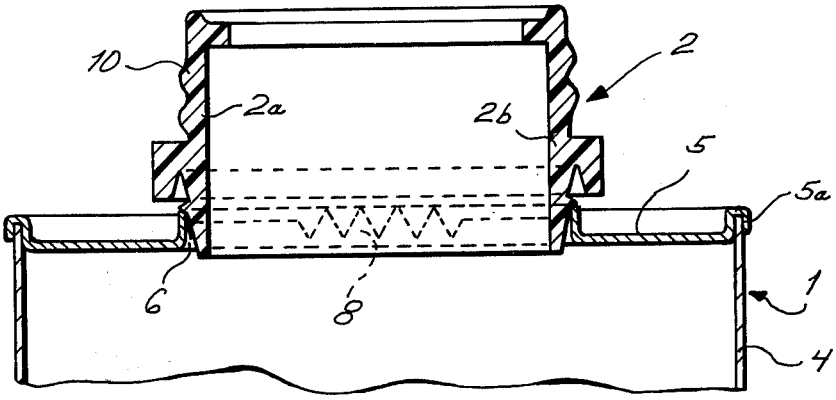
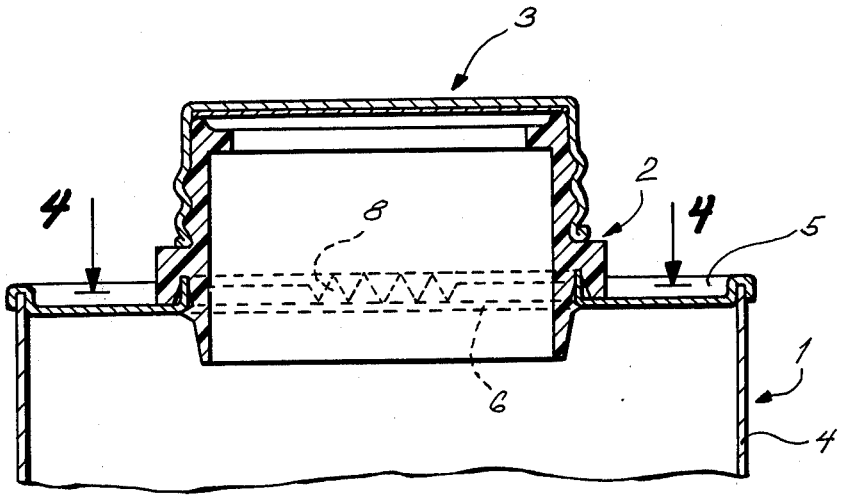
FIG. 3

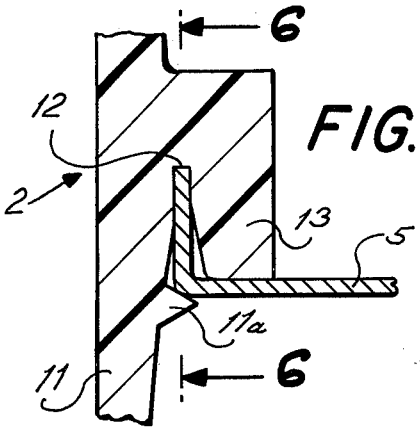
FIG. 5
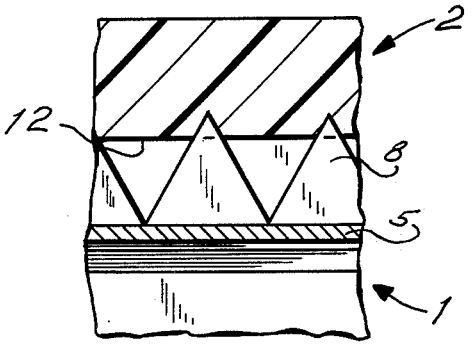
FIG. 6
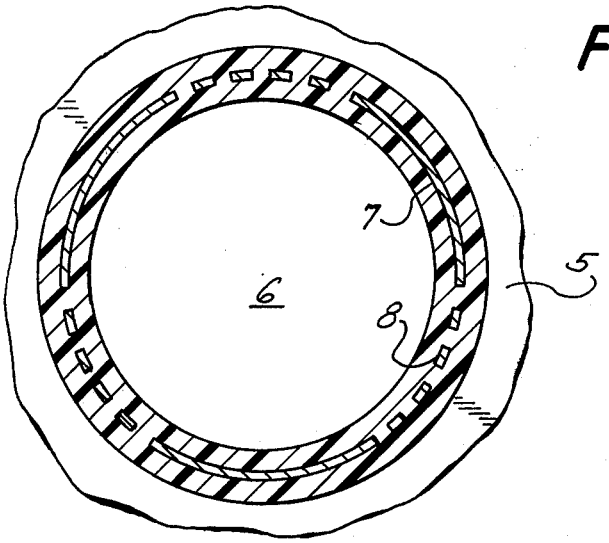
FIG. 4
FIG. 7
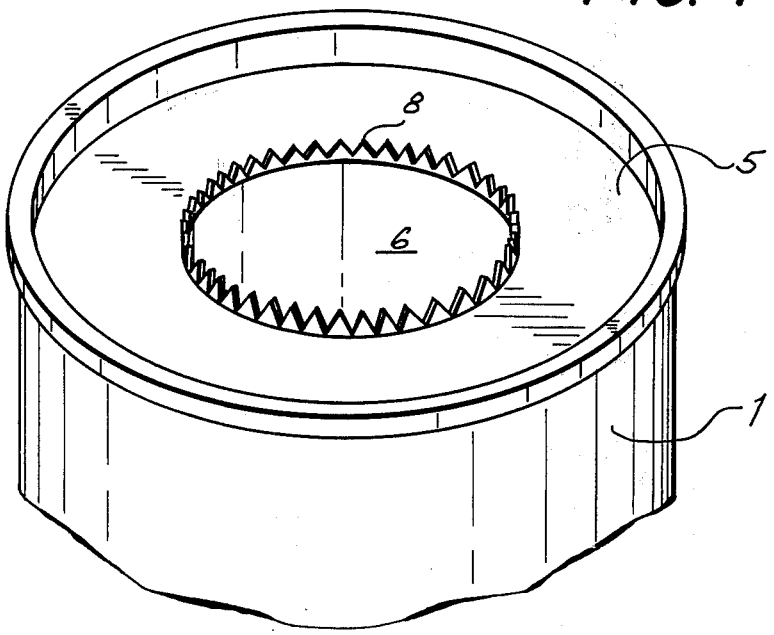

DISPENSING DEVICE COMPOSED OF A CAN AND A NOZZLE FIXEDLY ATTACHABLE THERETO

THE INVENTION

The invention relates to a dispensing device composed of a can and a nozzle fixedly secured to the can, and more particularly to a dispensing device in which the can and the nozzle are assembled by forcing the nozzle into and through an opening in the top wall of the can.

BACKGROUND

With a dispensing device of the general kind above-referred to, the can is usually made of sheet metal or other suitable form-retaining and substantially rigid material, and the nozzle is made of a suitable synthetic plastics material such as polyethylene or polyvinyl chloride which is sufficiently stiff but has some inherent flexibility or yielding property. The can and the nozzle therefor are manufactured independently and by different manufacturing operations. The nozzle is fixedly secured within the can by forcing a circumferential protrusion on the nozzle past the rim of an opening in the top wall of the can by utilizing the inherent flexibility of the nozzle material. This protrusion prevents detachment of the nozzle from the can by a pull on the nozzle in an axial direction but it does not prevent rotation of the nozzle relative to the can. A dispensing device of the kind here-involved is closed when not in use by means of a screw cap or closure cap retained on the nozzle, for instance, by a bayonet lock. Obviously, screwing on or off of a cap applies a rotational force to the cap relative to the can. Hence, it is essential that the nozzle is secured to the can not only against withdrawal in axial direction but also against rotation, as otherwise the nozzle would rotate together with the closure cap relative to the can when and while an attempt is made to screw a closure cap on or off.

There are known dispensing devices of the general kind above-referred to in which the nozzle is secured against rotation relative to the can. Such dispensing devices are shown in applicant's prior U.S. Pat. No. 3,388,842, issued June 18, 1968. According to this patent, the nozzle is provided with one or more protrusions which are movable into registry with notches or cut-outs in a flange protruding from the rim of the opening in the can. Such engagement of the protrusions with the cut-outs will secure the nozzle against rotation relative to the can, but it does require careful placement of the nozzle in a definite angular position relative to the can.

Dispensing devices of the kind herein referred to are inexpensive items which are produced and assembled by mass-production techniques. The manufacturing and assembly costs are very important factors with devices of this kind and must be calculated in fractions of pennies. The need for turning the nozzle into a definite and very narrowly limited position constitutes an operational step which substantially slows production of assembled dispensing devices and thus correspondingly increases the over-all costs of assembling the dispensing devices.

THE INVENTION

A broad object of the invention is to provide a novel and improved dispensing device of the general kind above-referred to which simplifies the assembly of the device by eliminating the operational step of accurately locating the nozzle relative to the can during the assembly of the device.

It is a more specific object of the invention to provide a novel and improved dispensing device of the general kind above-referred to in which the nozzle can be secured against rotation relative to the can in any angular position of the nozzle relative to the can.

Another more specific object of the invention is to provide on the can along the rim of the can opening, groups of pointed serrations which, when the nozzle is forced into and through the can opening, automatically bite into the material of the nozzle in any angular position of the nozzle relative to the can thereby considerably simplifying the assembly of the device and thus correspondingly reducing the over-all costs of manufacturing the devices by mass-production techniques.

SUMMARY OF THE INVENTION

The afore-pointed out objects, features and advantages, and other objects, features and advantages which will be pointed out hereinafter are obtained by providing along a flange extending from the rim of an opening in the top wall of the can normal to said top wall and including in said flange serrations terminating in a sharp point or cutting edge, and by further providing in the nozzle a flange which has a flat or plane surface on its side facing the can when the nozzle is forced into and through the can opening. The serrations, and especially the pointed or cutting apices of the serrations and the plane surface of the flange on the nozzle are so located and correlated that when the hereinbefore described circumferential protrusion on the nozzle is forced past the level of the top wall in the can, automatically bite into the nozzle material of which said flange is formed.

As it is now apparent, such biting of the serrations into the material of the nozzle constitutes a positive coupling between the can and the nozzle which is strong enough to resist the tendency of the nozzle to rotate relative to the can when a screw cap or similar closure cap is screwed on to the nozzle or screwed off.

As it is also evident, the serrations will bite into the flange in any angular position of the nozzle relative to the can in which the nozzle is forced into and through the can opening.

Either circumferentially spaced serrations may be provided or serrations occupying the entire peripheral outline of the rim of the opening in the top wall of the can. The serrations have preferably a substantially triangular configuration and terminate in a sharp point.

BRIEF DESCRIPTION OF THE DRAWING

In the accompanying drawing, several embodiments of the invention are described by way of illustration and not by way of limitation.

In the drawing:

FIG. 2 is an elevational sectional view of an intermediate stage in the assembly of the device;

FIG. 3 is an elevational sectional view of a fully assembled device;

FIG. 4 is a section taken on line 4—4 of FIG. 3;

FIG. 5 is a fragmentary sectional view of FIG. 3 on an enlarged scale;

FIG. 6 is a section along lines 606 of FIG. 5; and

FIG. 7 is a perspective view of a modification of the container constituting part of the device.

DETAILED DESCRIPTION OF THE DRAWING

Figure 1:
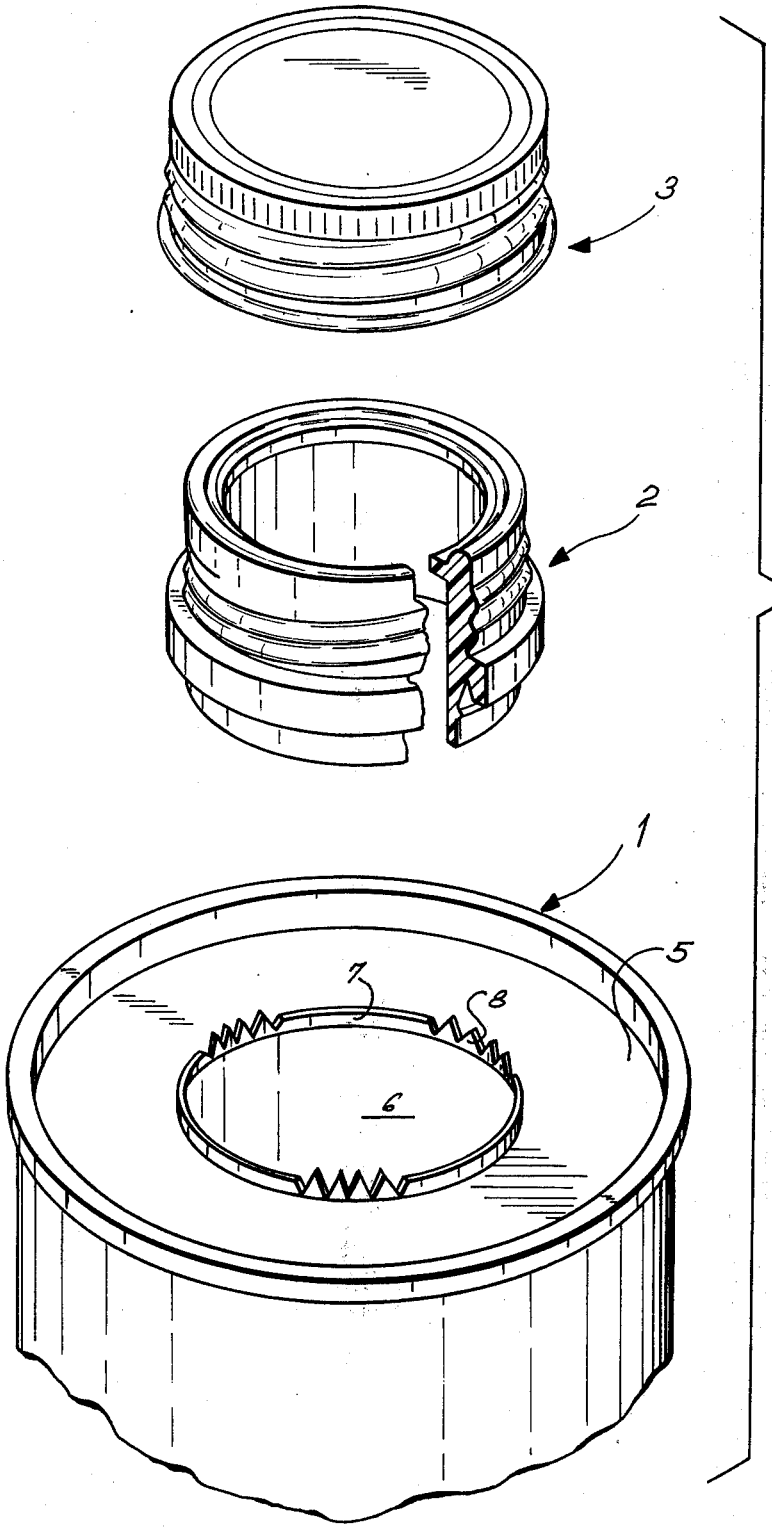
FIG. 1 is an exploded perspective view of a dispensing device according to the invention.

Referring now to the figures more in detail, and first to FIG. 1, this figure shows that the device according to the invention is composed of three parts; namely, a container 1, a nozzle 2 and a closure cap 3.

The container is in the form of a can 4 made of substantially rigid material such as sheet metal. The can has a top wall 5 suitably secured to the side wall of the can, for instance, by beading and/or soldering as indicated at 5a. The top wall has a circular opening 6 for filling the container with material and discharging the same therefrom. The material may be a liquid or pulverized material. As may be noted, the opening is shown to be rather large in relation to the size of the can to facilitate filling of the can with material and discharging it therefrom. Secured to the rim of opening 6 is a peripheral flange 7 which may either be integral with the top wall or suitably secured thereto. The flange includes as best shown in FIG. 1, three groups of serrations 8. These serrations are shown as being triangular and each terminating in a sharp point. Of course, serrations may also have another configuration; it is only essential that they terminate in a sharp point or edge protruding over the flat edge of flange 7 as it is clearly shown in FIG. 1. FIG. 1 shows three groups of serrations. However, more or less groups may be provided, or as shown in FIG. 7, the serrations may occupy the entire peripheral outline of top wall 5. Theremay also be provided a plurality of circumferentially spaced serrations.

Nozzle 2 is of substantially tubular configuration and made of a synthetic plastics material which is sufficiently rigid and form-retaining, but has some inherent flexibility. A suitable plastics material for the purpose is, for instance, a polyethylene or polyvinyl chloride. The upper portion of the nozzle is formed with threads 10 on its outer surface for screwing on and off screw cap 3. However, instead of a screw cap, a closure cap attachable by means of a bayonet lock may be used.

The lower portion **2*b* of the nozzle has an outer surface 11 which defines at and near its bottom edge a diameter which is smaller than the diameter of top wall opening 6 and is tapered into a peripheral protrusion 11*a* which defines a diameter larger than the diameter of top wall opening 6. The outer surface wall of the lower nozzle portion is continued above protrusion 11*a* and defines a flange 12 which is plane on its downwardly facing surface, as it is best shown in FIG. 5. The lower nozzle portion further comprises a downwardly extended skirt 13 which together with flange 12 forms a circumferential channel within the lower nozzle portion, as it is shown in FIGS. 2 and 3 and on an enlarged scale in FIG. 5**.

ASSEMBLY OF CAN 1 AND NOZZLE 2

As previously described, assembly of the dispensing device requires that the nozzle is fixedly secured to can 1 in a manner so that the nozzle cannot be axially pulled out of the can, and also that rotation of the nozzle relative to the can is restrained. As also previously described, screwing on or off of cap 2 inherently applies a rotational force to the nozzle. Obviously, rotation of the cap relative to the can would make difficult or at least very inconvenient to screw the cap on or off. The same is true if the cap is of the type having a bayonet lock.

Referring now to FIG. 2, the nozzle is inserted into the top wall opening 6. Such insertion can be smoothly and automatically effected since, as previously described, the outer diameter at the lower end of the nozzle is less than the diameter of the top wall opening, and thus also of the serrations upwardly extending from the rim of the opening. FIG. 2 shows the stage in which the nozzle has been inserted to a depth at which protrusion 11a just abuts against the top of the serrations 8.

Further downward pressure will force the protrusion 11a past the inside of flange 7 due to the inherent slight flexibility of the plastics material on which the nozzle is made. FIG. 3 shows the nozzle in its fully inserted position in the can. The nozzle is now locked in the can against withdrawal in axial direction.

In addition to locking the nozzle in axial direction, forcing the nozzle into the position of FIG. 3, the downward pressure applied to the nozzle also causes the pointed tips of serrations 8 to bite into the plane surface of flange 12. As a result, the nozzle is now also restrained against rotation relative to the can.

As is evident from the previous discussion, restraint of the nozzle against rotation will be automatically effected in any angular position of the nozzle relative to the can. In other words, it is no longer necessary to adjust the angular position relative to the can and the nozzle so that the heretofore used locking components on the can and the nozzle are moved into registry. As it is also shown in FIG. 3, skirt 13 is so dimensioned that it will abut against top wall 5 just when serrations 8 have bitten sufficiently into the material of which the nozzle is formed thereby preventing damage to the nozzle by application of excessive pressure. Of course, it is also within the concept of the invention to reduce the axial length of skirt 13 to any length that may be more suitable.

While the invention has been described in detail with respect to certain now preferred examples and embodiments of the invention, it will be understood by those skilled in the art, after understanding the invention, that various changes and modifications may be made without departing from the spirit and scope of the invention, and it is intended, therefore, to cover all such changes and modifications in the appended claims.

I claim:

1. An assemblage of a dispensing device comprising in combination:

a container for material to be dispensed and a nozzle fixedly attachable to the container;

said container being made of a hard and rigid material and having a top wall including a circular opening for dispensing material through said opening and for receiving said nozzle, and including a plurality of generally tooth-shaped serrations each terminating in a sharp point and extending upwardly circumferentially spaced from and about the rim defining the top wall opening substantially normal to said top wall; and said nozzle being made of a form-retaining but flexible synthetic plastics material softer than the material of the serrations on the container and being of generally tubular configuration, said nozzle having an upper portion for releasably receiving a screw cap and a lower portion for locking the nozzle to the container, said upper nozzle portion having on its outer wall threads for screwing on and off a screw cap by rotating the cap relative to the nozzle and the container, and said lower portion of the nozzle having an outer wall surface increasing from a diameter less than the diameter of said top wall opening from the lower edge of said outer surface to a diameter larger than the diameter of the top wall opening diameter whereby upon forcing the lower nozzle wall portion through the top wall opening into a position in which the wall surface part having the diameter larger than the diameter of the top wall opening is located below the level of the top wall opening the nozzle is locked against axial withdrawal from the container, said lower nozzle portion further having on its outer surface a circular flange radially outwardly extending from said outer surface, said flange defining a substantially plane surface on its side facing the lower edge of the nozzle, said surface being substantially parallel with the top wall and normal to the serrations when the nozzle is in its locked position, the height of the serrations and the location of the plane surface of the flange being so correlated that upon axially downwardly pressing the lower nozzle portion into and through the top wall opening the points of said serrations bite into the plane flange surface in any rotational position of the nozzle relative to the container thereby locking the nozzle against rotation relative to the container.

2. The assemblage according to claim 1 and comprising a circumferential skirt extending from the outer peripheral edge of said flange toward the lower edge of the lower nozzle portion and substantially parallel to but spaced apart from said outer wall surface of the lower nozzle portion, the axial length of said skirt being such that its lower edge abuts against the top wall of the container when said lower nozzle portion has been inserted into and through said top wall opening thereby limiting the depth of the bite of said serrations into the flange of the nozzle.

3. The assemblage according to claim 1 wherein said serrations are arranged in the form of groups of several serrations, said groups being circumferentially spaced from each other.

4. The assemblage according to claim 1 wherein said serrations occupy the entire circumferential outline of said top wall opening.

5. The assemblage according to claim 1 wherein said container is made of sheet metal and said serrations are of triangular configuration and integral with said top wall.

6. The assemblage according to claim 1 wherein said outer wall surface of the lower nozzle portion includes intermediate its length a circumferential protrusion, the outer diameter of said protrusion constituting the part of the outer wall surface having the diameter larger than the diameter of the top wall opening.

* * * * *